US005666943A

United States Patent [19]

Adams

[11] Patent Number: 5,666,943

[45] Date of Patent: Sep. 16, 1997

[54] WATER HEATER OR BOILER WITH IMPROVED TANK DESIGN

[75] Inventor: Charles L. Adams, Fort Worth, Tex.

[73] Assignee: PVI Industries, Inc., Fort Worth, Tex.

[21] Appl. No.: 552,007

[22] Filed: Nov. 2, 1995

[51] Int. Cl.[6] ..... F24H 1/20

[52] U.S. Cl. ..... 126/360 R; 126/350 R; 122/17; 122/19

[58] Field of Search ..... 126/361, 350 R, 126/360 R, 360 A, 366, 368; 122/14, 17, 19, 33, 32, 13 R

[56] References Cited

U.S. PATENT DOCUMENTS

| | | | |
|---|---|---|---|
| 2,814,278 | 11/1957 | Cameron | 122/17 |
| 4,524,726 | 6/1985 | Bindl | 122/13 R |
| 4,552,210 | 11/1985 | Malaval | 165/134.1 |
| 4,685,425 | 8/1987 | Eising | 126/350 R |
| 4,938,204 | 7/1990 | Adams | 126/360 R |
| 4,981,112 | 1/1991 | Adams et al. | 122/19 |
| 5,197,415 | 3/1993 | Stretch et al. | 122/17 |
| 5,437,249 | 8/1995 | Adams et al. | 126/360 R |

*Primary Examiner*—James C. Yeung
*Attorney, Agent, or Firm*—Charles D. Gunter, Jr.

[57] ABSTRACT

A water heater/boiler design is shown having a tank with a submergible, pressurized combustion chamber and a resilient sealing means which divides the interior of the water heater tank into a primary and secondary heat exchange compartments. A forced draft burner is used to heat the combustion chamber with the products of combustion passing through multiple heat exchange surfaces to a flue collector located on the exterior of the device.

16 Claims, 3 Drawing Sheets

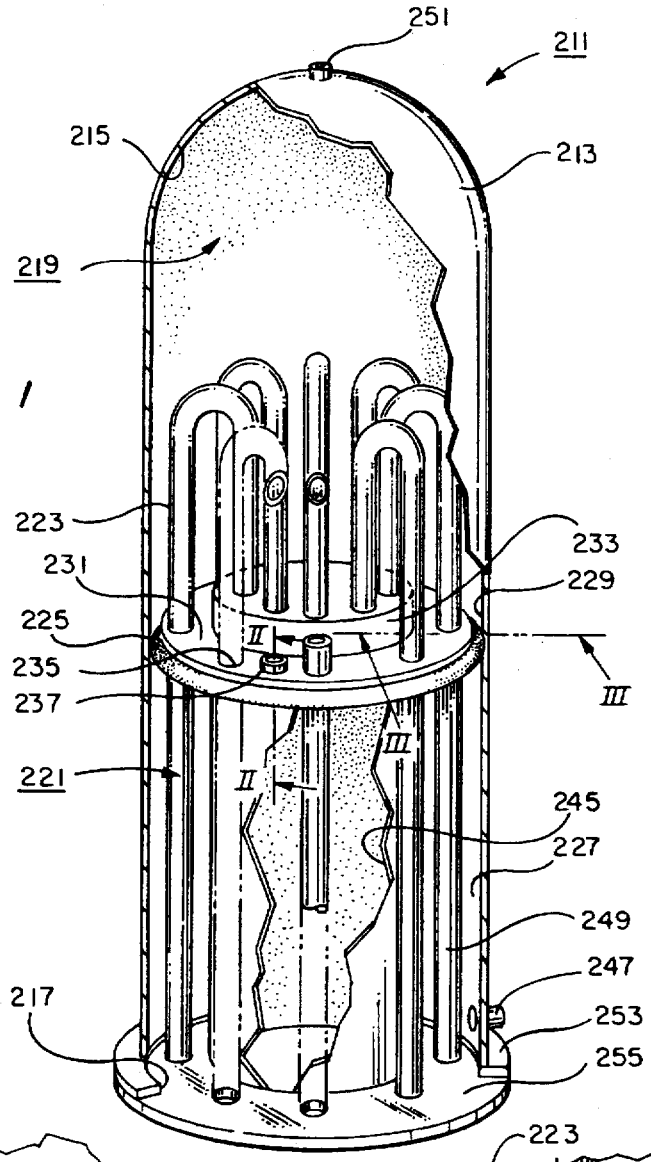
FIG. 1
FIG. 2
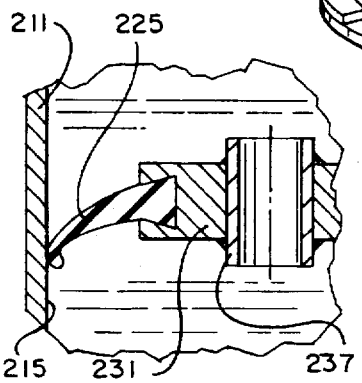
FIG. 3
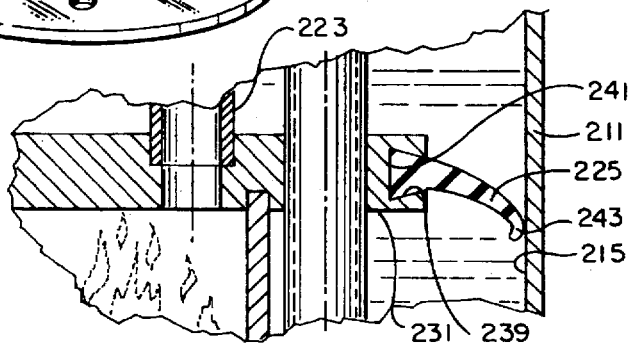

WATER HEATER OR BOILER WITH IMPROVED TANK DESIGN

BACKGROUND OF THE INVENTION

1. Field of the Invention

The present invention relates generally to gas, oil and gas/oil fired water heaters and boilers of the type utilizing a submergible combustion chamber and to an improved tank design for such a water heater or boiler.

2. Description of the Prior Art

Prior art water heaters of the type under consideration have typically provided for the flow of hot gas through a series of tubes which are mounted in vertical fashion between top and bottom support plates within the water heater tank. In this discussion, the term "water heater" will be understood to encompass both water heaters and "boilers" of the type utilized for commercial/industrial use, as well as for residential use. Water was circulated into and out of a chamber in the prior art device located between the support plates. The water contacted and circulated about the exterior of vertical tubes to effect heat transfer to heat the water.

The typical prior art gas, oil or gas/oil-fired water heater featured a non-pressurized external combustion chamber. The location of the combustion chamber on the exterior of the water heater resulted in lost heat and lower thermal efficiency. Also, the tubes and support plates were not easily accessible which generally required disassembly of the entire tank for maintenance and replacement.

In U.S. Pat. Nos. 4,465,024 and 4,545,329, both assigned to the assignee of the present invention, a water heater design was shown which featured a submergible, pressurized combustion chamber so that all combustion took place in the water heater tank interior in a chamber surrounded by water. The resulting design decreased heat loss and increased the thermal efficiency of the water heater in the range of 83% (fuel to water) and above. ANSI standard Z.21.10.3 outlines the accepted industry method of testing thermal efficiency of a water heater.

In spite of such improvements, a need continued to exist for a water heater design with a thermal efficiency exceeding that achievable by the previously described submerged combustion chamber alone. In U.S. Pat. No. 4,938,204, a further improvement to the previous designs was disclosed. In the '204 patent, a water heater design was shown characterized by a thermal efficiency (fuel to water) of 98% and above. This design included a closed tank containing water under pressure with a side wall having a primary side wall opening. A submergible, pressurized combustion chamber was installed within the primary sidewall opening so that all of the heating surfaces were submerged in the water under pressure at a first location within the tank. A secondary heat exchange means was provided for preheating water at a second location which is below the first location within the closed tank. Passage means conducted the products of combustion generated in the submerged combustion chamber to the secondary heat exchange means so that cooler water entering the tank is preheated by the secondary heat exchange means prior to contacting the external heating surfaces of the submerged combustion chamber.

In one embodiment of the invention described in the '204 patent, the two tank locations were actually separate tanks which were separated by a divider plate. A cross-over tube provided fluid communication to allow water to pass from the preheat zone to the primary heat exchange zone. Using this design, a 99% thermal efficiency was verified by independent third party testing.

Despite the advantages afforded by the design shown in the '024 patent, a need existed to provide a simplified tank design while maintaining the increased thermal efficiency provided by primary and secondary heat exchange compartments. Accordingly, the present invention provides a single tank design having a novel combustion chamber arrangement which divides the single tank into a primary and secondary heat exchange compartments.

The present design also features a removable combustion chamber which forms a sliding seal with respect to the surrounding water heater tank interior when the combustion chamber is installed within an end opening of the tank.

The water heater design of the invention is characterized by a thermal efficiency (fuel to water) of 98% and above while offering a simplified design with fewer components which occupies less space than the designs of the prior art.

SUMMARY OF THE INVENTION

A water heater is shown which includes a tank having external and internal side walls and an end opening. The internal side walls define an open interior normally containing water under pressure. A submergible, pressurized combustion chamber having at least one external heating surface is insertible through the end opening into the open interior, whereby the external heating surface is submerged in the water under pressure. Combustion means are provided for supplying the products of combustion to the submergible, pressurized combustion chamber. A resilient sealing means is carried by the submergible, pressurized combustion chamber for forming a sliding seal with the tank internal side walls as the combustion chamber is inserted within the tank interior, whereby the initially open interior of the tank is divided into a primary and secondary heat exchange compartments. A cross-over means allows the controlled passage of water from a selected one of the heat exchange compartments to the other.

Preferably, the combustion means is an air-fed, forced-draft burner having a burner inlet and being mounted on the exterior of the closed tank and communicating with the combustion chamber for causing combustion to take place within the submergible, pressurized combustion chamber so that substantially all combustion occurs in the tank interior to minimize heat loss.

The resilient sealing means can include a rigid divider plate carried by the submergible, pressurized combustion chamber. The rigid divider plate has attached thereto a resilient wiper sealing surface for forming a sliding seal within the tank's internal side walls as the combustion chamber is inserted within the tank interior. The cross-over means can be a tube which passes through the divider plate and establishes communication between the primary and secondary heat exchange compartments.

Additional objects, features and advantages will be apparent in the written description which follows.

BRIEF DESCRIPTION OF THE DRAWINGS

FIG. 1 is a perspective view of the improved water heater of the invention with the tank's side walls partially broken away to better illustrate the submergible combustion chamber and resilient sealing means of the invention.

FIG. 2 is a close-up, isolated view taken along lines II—II in FIG. 1, partially in section, showing the resilient wiper means of the invention.

FIG. 3 is a close-up, isolated view of a portion of the tank interior, partially in section, showing the combustion chamber, fire tube arrangement and resilient sealing means of the invention.

DETAILED DESCRIPTION OF THE INVENTION

Figure 4:
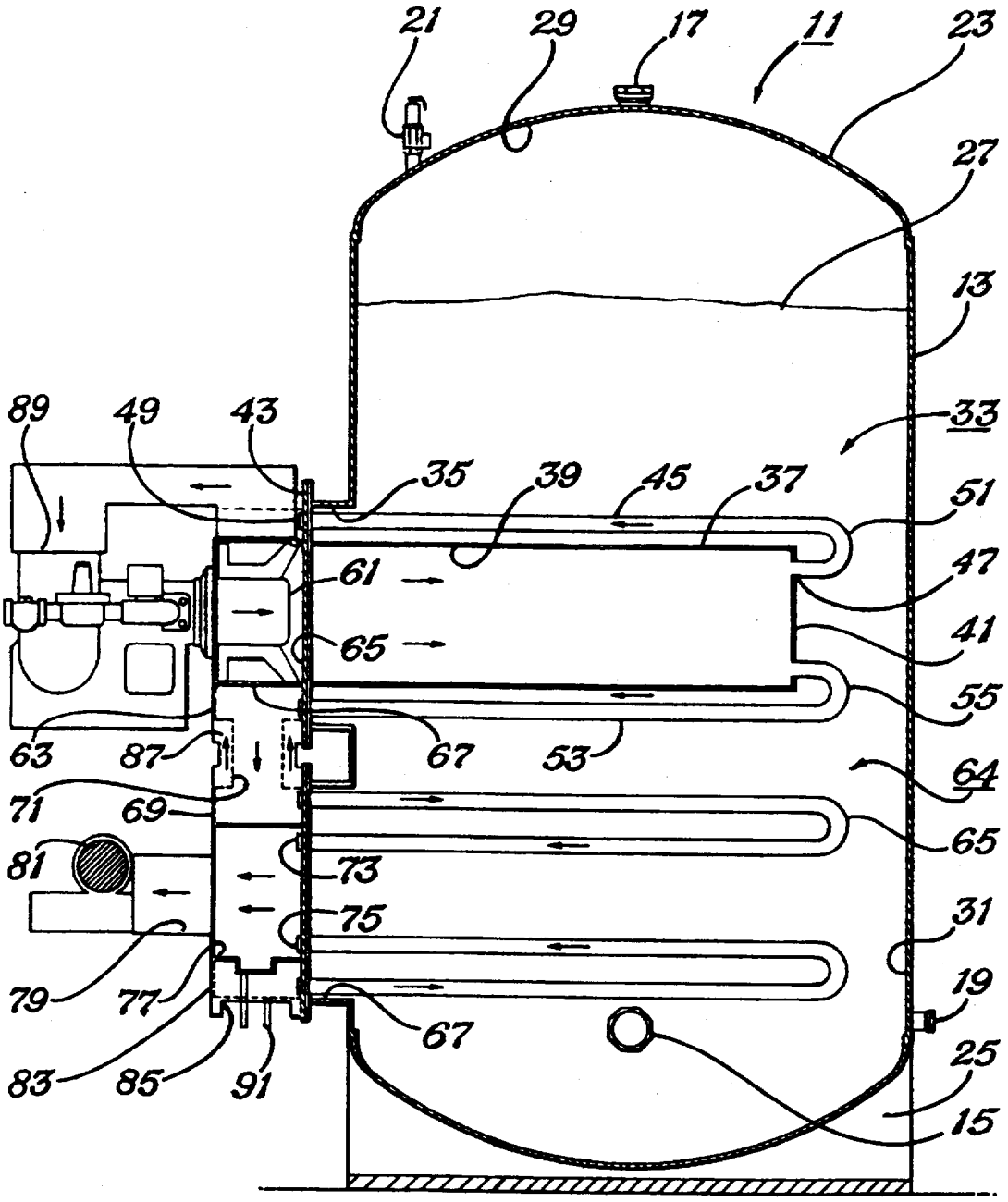
FIG. 4 PRIOR ART
FIG. 4 is a side, schematic view of a single tank water heater of the prior art design showing the circulation of the combustion air and products of combustion through the internal components of the apparatus.

Turning first to FIG. 4, there is shown a prior art water heater toward which the improvement of the present invention is directed. The prior art water heater is designated generally as 11 and includes a storage tank 13 with a normally closed interior containing water under pressure. The tank 13 has a cold water inlet 15, a hot water outlet 17, a drain valve 19 and a safety pressure release valve 21. The tank 13 is provided with a generally cylindrical body portion having heads or closures on both ends, such a head 23 and a stabilizer skirt 25. A typical water level is indicated at 27 with the upper region 29 of the tank containing steam and the lower region 31 containing cooler water entering the tank from the cold water inlet 15.

A submergible, pressurized combustion chamber assembly, designed generally as 33, is adapted to be received within a primary side wall opening 35 in tank 13. The submergible portion of the assembly includes a combustion chamber portion 37 adapted to be received within the tank opening 35. Submergible combustion chamber portion 37 comprises a cylindrical elongated member having an open end 39 and having an opposite closed end 41. The combustion chamber assembly 33 also includes a mounting portion for detachably engaging the tank opening 35 for mounting the assembly 33 within the tank. The mounting portion can conveniently comprise a tube mounting flange 43 located adjacent and connected to the combustion chamber open end 39. The tube mounting flange 43 can be a ring-like body having an opening in the central part thereof which opening coincides with the opening in open end 39 of the combustion chamber 37. The flange 43 can be securely affixed to the chamber 37 as by welding or the like.

The combustion chamber assembly 33 also includes a plurality of curved fire tubes 45, each of which has an end 47 which communicates with the combustion chamber 37 through closed end 41 and which has an opposite end 49 which extends through the opening 35 when in place on tank 13 to the tank exterior. Each of the curved fire tubes 43 is characterized in that at least a portion 51 of the length thereof is generally U-shaped. The configuration shown in FIG. 1 has a combustion chamber 37 which extends substantially the length of the curved fire tubes 45 creating a long leg 53 running along the exterior of the combustion chamber 37 and separated by a U-shaped portion 51 from a short leg 55 which joins and extends through closed end 41.

The ends 49 of the curved tubes 45 preferably extend to the tube mounting flange 43 and communicate through flange 43 when the assembly 33 is received within the primary side wall opening. The tube ends 49 can be secured to the flange 43 as by braising the tube ends on the front and back sides of flange 43. Although a small number of curved tubes 45 are shown in FIG. 1 for simplicity, a greater number of tubes and openings are typically used in practice.

The combustion chamber assembly 33 can be mounted on the tank in any convenient fashion. For instance, the tank can be provided with a tank mounting flange comprising a cylindrical ring which is fixedly connected to the tank exterior so as to circumscribe the opening 35 in tank 13 and to extend outwardly therefrom generally normal to the vertical side walls of the tank 13. The end area of the tank mounting flange can be provided with a plurality of threaded bores which are suitably spaced and alignable with matching bores in the tube flange, whereby the fire tube assembly can be bolted to the tank mounting flange.

A flue collector 63 is mounted on the tube mounting flange 43 and has an opening 65 which communicates with the combustion chamber portion 37 and an annular chamber 67 which communicates with the fire tubes 45 by means of openings in the flange 43.

A heat source such as a burner nozzle 61 from an air-fed, forced-draft burner is provided with a series of holes which made with and receive lugs for bolting the nozzle 61 onto the flue collector 63. In this way, the nozzle burner opening can communicate with the combustion chamber assembly 37, whereby heat from the burner passes through the interior of the submerged combustion chamber 37 and through the fire tubes 45 into the annular chamber of the flue collector 63. Preferably, the nozzle burner 61 is constructed to work against a positive pressure.

In the embodiment of FIG. 4, a secondary heat exchange means, such as heat exchanger 64 is provided in the tank 13 for preheating the cold water entering the inlet 15 in the lower region 31 of the tank 13. The heat exchanger 64 has at least one heat exchange tube 65 which extends through a secondary side wall opening 67 provided in the tank 13 so that the heat exchange tube 65 is submerged in water under pressure. Preferably, a plurality of heat exchange tubes 65 are provided. A divider plate (not shown) can be present in the tank 11 between the primary combustion chamber assembly 33 and the secondary heat exchanger 64 to divide the tank interior into an upper and lower compartment.

As shown in FIG. 4, the heat exchange 64 is provided with a secondary flue collector 69 similar to the primary flue collector. Passage means 71 connect the primary and secondary flue collectors, whereby the products of combustion generated by the forced draft burner in the combustion chamber 37 are supplied to the heat exchange tube 65 in the secondary heat exchanger 63.

The heat exchange tube 65 are preferably U-shaped with the products of combustion exiting the tube ends 73, 75 and passing through the central opening 77 in the secondary flue collector to an exhaust outlet 79 to be exhausted from the tank. An exhaust fan or power vent 81 assists in pulling the products of combustion from the combustion chamber through the primary and secondary flue collectors and out the exhaust outlet 79.

The primary and secondary flue collectors are surrounded by a pre-heat cowling 83 which includes a combustion air inlet 85 and an internal flow path 87 for conducting combustion air 85 over the primary and secondary flue collectors to the burner inlet 89. Condensate outlet 91 is provided for removing condensate created by the warming of the combustion air as it travels over the flue collectors.

Figure 5:
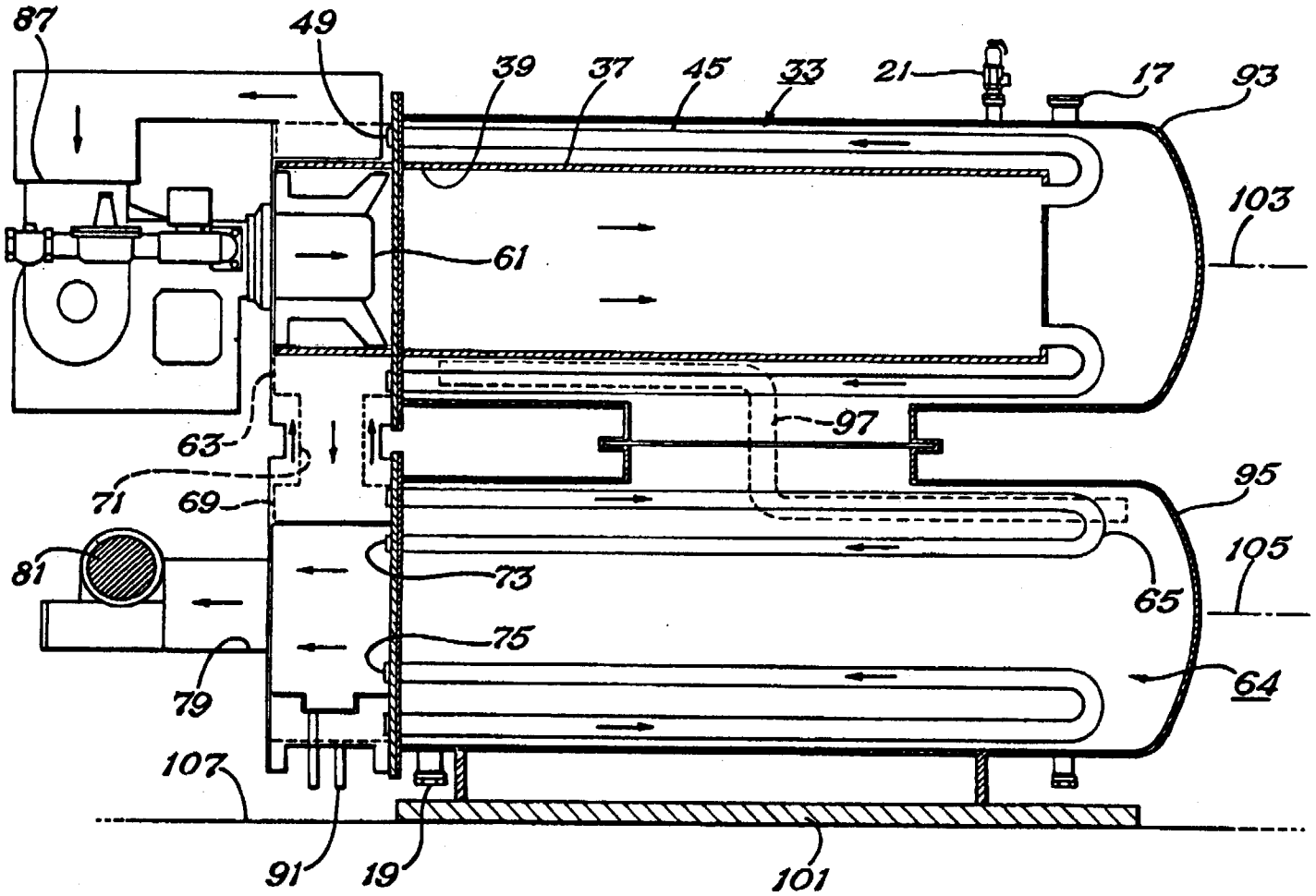
FIG. 5 PRIOR ART
FIG. 5 is a side, schematic view of a prior art device similar to FIG. 4 but showing a dual-tank water heater.

FIG. 5 illustrates another embodiment of the prior art device which features a dual water storage tank arrangement. The submergible pressurized combustion chamber assembly 33 is mounted within the combustion tank 93 while the secondary heat exchanger 64 is mounted within a separate preheat tank 95. A cross-over tube assembly 97 establishes fluid communication between the preheat tank 95 and the combustion tank 93. The preheat and combustion tanks are supported by a base 101 on a surrounding support surface, such as the floor. Each of the tanks has a longitudinal axis 103, 105 which are parallel to the plane of the surrounding support surface 107. Preferably, the combustion tank 93 is mounted on the base 101 over the preheat tank 95 in vertical fashion with the axes 103, 105 extending in parallel planes with respect to the support surface 107.

Having described the prior art device, the advantages of the present invention will be apparent from FIGS. 1–3. Turning to FIG. 1, the water heater of the invention includes a tank 211 having external and internal side walls 213, 215 and an end opening 217. The internal side walls 215 define an open interior 219 normally containing water under pressure.

A submergible, pressurized combustion chamber 221, similar to that previously described, is insertible through the end opening 217 into the open interior 219, whereby the external heating surfaces 223 are submerged in the water under pressure.

As will apparent from FIGS. 1–3, a resilient sealing means 225 is carried by the submergible, pressurized combustion chamber 221 for forming a sliding seal with the tank internal side walls 215 as the combustion chamber 221 is inserted within the tank interior 219, whereby the initially open interior 219 is divided into a primary and secondary heat exchange compartments, 227, 229, respectively. The resilient sealing means 225 preferably includes a rigid divider plate 231 which can be formed, for example, of steel and which is carried by the submergible combustion chamber. As shown in FIG. 1, the divider plate 231 is secured to the exterior 233 of the cylindrical body portion of the combustion chamber in a plane generally normal thereto and has a plurality of openings 235 for allowing the fire tubes to pass therethrough. However, the fire tube openings 235 sealingly engage the fire tubes so that water does not pass about the fire tubes.

A cross-over means such as cross-over tube 237 allows the controlled passage of water from a selected one of the heat exchange compartments 227, 229 to the other. In this case, the tube 237 allows cooler water which has been preheated in primary heat exchange compartment 227 to enter the secondary heat exchange compartment 229.

As shown in greater detail in FIGS. 2 and 3, the divider plate 231 includes an external, circumferential groove 239 into which is received a wedge-shaped portion 241 of a rubber wiper seal 225. The wiper seal is tapered and gradually diminishes in cross-section between the wedge-shaped portion 241 and an outer tip region 243 which makes sliding contact with the internal side wall 215 of the surrounding tank. The wiper seal 225 can be formed of, for example, nitrile rubber.

The sliding combustion chamber module 221 is secured to the tank lower flange 253 by means of a mating flange 255 and any convenient connector means, such as bolts, or the like (now shown).

Any convenient combustion means can be utilized to supply the products of combustion to the interior 245 of the combustion chamber 221 (FIG. 1). Preferably, the combustion means is an air-fed, forced draft burner which is mounted on the exterior of the closed tanks and communicates with the combustion chamber interior for causing combustion to take place within the submerged, pressurized combustion chamber. The forced draft burner can be identical to that previously described with respect to FIGS. 4 and 5.

As best seen in FIG. 1, a cold water inlet 247 admits water to the primary heat exchange compartment 227 which is formed generally below the region of contact of the resilient sealing means 225 with the tank internal side walls 215. After being warmed by the products of combustion within the interior 245 of the combustion chamber and the heat exchange effect between the lower portion 249 of the fire tubes, the water passes at a controlled rate through the cross-over tube 237 into the secondary heat exchange compartment defined generally above the divider plate 221 within the tank interior. Here, the water is further heated by contact with the external heat exchange surfaces of the combustion chamber 221 and the fire tube surfaces 223 before passing through a hot water outlet 251 located in the top of the tank.

An invention has been provided with several advantages. A device of the type shown can accommodate a variety of BTU capacity requirements. The devise can utilize a gas, oil or gas/oil-type burner as the power source. The water heater is simple in design and economical to manufacture. The combustion chamber assembly can be removed from the tank for ease of maintenance and/or replacement. The submerged combustion chamber, along with the submerged fire tubes and divided tank arrangement, can provide a fuel to water thermal efficiency which exceeds 98%. Because the entering cold water is preheated, thermal shock is minimized or eliminated, adding to the life of the device. The flexible resilient seal carried by the divider plate of the combustion chamber assembly divides the tank interior into a primary and secondary heat exchange compartment without the necessity of providing separate physical tanks.

While the invention has been shown in only one of its forms, it is not thus limited but is susceptible to various changes and modifications without departing from the spirit thereof.

What is claimed is:

1. A water heater including a tank having external and internal sidewalls and an end opening, the internal sidewalls defining an open interior normally containing water under pressure, the improvement comprising:

a submergible, pressurized combustion chamber having at least one external heating surface, said combustion chamber being insertible through the end opening into the open interior whereby the external heating surface is submerged in the water under pressure;

combustion means for supplying the products of combustion to the submergible, pressurized combustion chamber;

resilient sealing means carried by the submergible, pressurized combustion chamber for forming a sliding seal with the tank internal sidewalls as the combustion chamber is inserted within the tank interior, whereby the initially open interior of the tank is divided into a primary and secondary heat exchange compartments;

a water inlet to a selected one of the heat exchange compartments and a water outlet from the other of the heat exchange compartments;

crossover means for allowing the controlled passage of water from a selected one of the heat exchange compartments to the other.

2. A water heater including a tank having external and internal sidewalls and an end opening, the internal sidewalls defining an open interior normally containing water under pressure, the improvement comprising:

a submergible, pressurized combustion chamber having multiple external heating surfaces, said combustion chamber being insertible through the end opening into the open interior whereby all of the external heating surfaces are submerged in the water under pressure;

combustion means for supplying the products of combustion to the submergible, pressurized combustion chamber;

resilient sealing means carried by the submergible, pressurized combustion chamber for forming a sliding seal with the tank internal sidewalls as the combustion chamber is inserted within the tank interior, whereby the initially open interior of the tank is divided into a primary and secondary heat exchange compartments;

a water inlet to the primary heat exchange compartment and a water outlet from the secondary heat exchange compartment;

crossover means for allowing the controlled passage of water from the primary heat exchange compartment to the secondary heat exchange compartment.

3. The water heater of claim 2, wherein the combustion means is an air-fed, forced draft burner having a burner inlet and being mounted on the exterior of the closed tank and communicating with said combustion chamber for causing combustion to take place within said submergible, pressurized combustion chamber so that substantially all combustion takes place in the tank interior to minimize heat loss.

4. The water heater of claim 3, wherein the resilient sealing means includes a rigid divider plate carried by the submergible, pressurized combustion chamber, the rigid divider plate having attached thereto a resilient wiper sealing surface for forming a sliding seal with the tank internal sidewalls as the combustion chamber is inserted within the tank interior.

5. The water heater of claim 4, wherein the crossover means is a tube which passes through the divider plate and communicates between the primary and secondary heat exchange compartments.

6. The water heater of claim 5, wherein the multiple external heating surfaces of the combustion chamber are a plurality of curved fire tubes.

7. The water heater of claim 6, further comprising:

mounting means for installing the combustion chamber within the end opening of the tank; and wherein the combustion chamber comprises a substantially cylindrical body portion having an open end located adjacent the mounting means which communicates with the exterior of the tank and a closed end at the opposite end of the body portion.

8. The water heater of claim 7, wherein each of the fire tubes has a short leg which extends through the closed end of the body portion to communicate with the interior of the combustion chamber at the closed end and a long leg which extends adjacent the body portion externally thereof and through said mounting means.

9. The water heater of claim 8, wherein a primary flue collector is mounted on the exterior of said closed tank having a flue opening therein which communicates with the open end of the body portion, the primary flue collector having an annular chamber surrounding the flue opening and separated therefrom, the annular chamber communicating with the long leg of each of the fire tubes through the mounting means.

10. The water heater of claim 9, wherein the burner has a nozzle for mounting through the flue opening wherein heat from the burner passes through the combustion chamber, through the fire tubes and into the primary flue collector.

11. The water heater of claim 10, wherein the forced draft burner creates a positive pressure within the combustion chamber for forcing the products of combustion through the fire tubes and through the primary flue collector to the exhaust outlet.

12. A water heater of the type having a tank with a tank interior which defines a preheat or primary heat exchange compartment and a secondary heat exchange compartment, both compartments normally containing water under pressure, the water heater comprising:

a submergible, pressurized combustion chamber with multiple external heating surfaces, said combustion chamber extending through an end opening of the water heater tank into an interior thereof so that all of the heating surfaces are submerged in the water under pressure;

an air-fed, forced draft burner having a burner inlet and being mounted on the exterior of the water heater tank and communicating with the combustion chamber for causing combustion to take place within the submergible, pressurized combustion chamber so that substantially all combustion takes place in the tank interior to minimize heat loss;

resilient sealing means carried by the submergible, pressurized combustion chamber for forming a sliding seal with the tank internal sidewalls as the combustion chamber is inserted within the tank interior, whereby the initially open interior of the tank is divided into the primary and secondary heat exchange compartments;

a water inlet to the primary heat exchange compartment and a water outlet from the secondary heat exchange compartment; and crossover means for allowing the controlled passage of water from the preheat or primary heat exchange compartment to the secondary heat exchange compartment.

13. A combustion chamber assembly for use in a water heater of the type having a tank having external and internal sidewalls and an end opening, the internal sidewalls defining an open interior normally containing water under pressure, the combustion chamber assembly including:

a combustion chamber body having multiple external heating surfaces, said combustion chamber body being insertible through the end opening into the open interior whereby all of the external heating surfaces are submerged in the water under pressure;

resilient sealing means carried by the combustion chamber body for forming a sliding seal with the tank internal sidewalls when the combustion chamber is inserted within the tank interior, whereby the initially open interior of the tank is divided into a primary and secondary heat exchange compartments wherein the resilient sealing means includes a rigid divider plate carried by the combustion chamber body, the rigid divider plate having attached thereto a resilient wiper sealing surface for forming a sliding seal with the tank internal sidewalls as the combustion chamber body is inserted within the tank interior; and wherein a water inlet is connected to a selected one of the heat exchange compartments of the tank and a water outlet is connected to the other of the heat exchange compartments and wherein a crossover opening located in the rigid divider plate allows water to pass from one selected heat exchange compartment to the other within the tank interior.

14. The combustion chamber assembly of claim 13, wherein the multiple external heating surfaces of the combustion chamber body are a plurality of curved fire tubes.

15. The water heater of claim 14, further comprising:

mounting means for installing the combustion chamber body within the end opening of the tank; and wherein the combustion chamber body comprises a substantially cylindrical body portion having an open end located adjacent the mounting means which communicates with the exterior of the tank and a closed end at the opposite end of the body portion.

16. The water heater of claim 15, wherein each of the fire tubes has a short leg which extends through the closed end of the body portion to communicate with the interior of the combustion chamber at the closed end and a long leg which extends adjacent the body portion through said mounting means.

* * * * *